US009266126B2

(12) United States Patent
Lee

(10) Patent No.: US 9,266,126 B2
(45) Date of Patent: Feb. 23, 2016

(54) WATER SPRAY PLATE

(76) Inventor: Jang Woo Lee, Guri (KR)

( * ) Notice: Subject to any disclaimer, the term of this patent is extended or adjusted under 35 U.S.C. 154(b) by 1061 days.

(21) Appl. No.: 13/381,648

(22) PCT Filed: May 27, 2010

(86) PCT No.: PCT/KR2010/003370

§ 371 (c)(1),
(2), (4) Date: Dec. 29, 2011

(87) PCT Pub. No.: WO2011/002162

PCT Pub. Date: Jan. 6, 2011

(65) Prior Publication Data

US 2012/0097770 A1 Apr. 26, 2012

(30) Foreign Application Priority Data

Jul. 1, 2009 (KR) ..... 10-2009-0059753

(51) Int. Cl.
*B05B 1/18* (2006.01)
*B05B 7/08* (2006.01)

(52) U.S. Cl.
CPC ..... *B05B 1/185* (2013.01); *B05B 7/0846* (2013.01)

(58) Field of Classification Search
CPC ..... B05B 1/02; B05B 1/14; B05B 1/185; B05B 7/0846; B05B 7/0807
USPC ..... 239/391, 390, 498, 552, 548, 497, 496, 239/601
See application file for complete search history.

(56) References Cited

U.S. PATENT DOCUMENTS 3,476,322 A * 11/1969 Dyck ..... 239/515
7,374,112 B1 * 5/2008 Bulan et al. ..... 239/556

FOREIGN PATENT DOCUMENTS

JP 2000-037641 A 2/2000
KR 10-0562076 B1 3/2006
KR 20-0413013 Y1 4/2006
KR 10-0867486 B1 11/2008
WO WO 2007007984 A1 * 1/2007

* cited by examiner

*Primary Examiner* — Arthur O Hall
*Assistant Examiner* — Viet Le
(74) *Attorney, Agent, or Firm* — Patent Office of Dr. Chung Park

(57) ABSTRACT

There is disclosed a water spray plate having micro-shower-holes formed therein to expand a passage area of liquid. The plurality of the shower hole arrays formed to unit sprayed liquids may be arranged and there may be an effect of enabling the user to feel that sufficient liquid is supplied even if a small amount of liquid is supplied. As a result, the substantial amount of the liquid used by the user may be reduced and there may be a water-saving effect.

3 Claims, 6 Drawing Sheets

WATER SPRAY PLATE

CROSS-REFERENCE TO PRIOR APPLICATIONS

This application is a national Stage Patent Application of PCT International Patent Application No. PCT/KR2010/003370, filed on May 27, 2010 under 35 U.S.C. §371, which claims priority of a Korean Patent Application No. 10-2009-0059753, filed on Jul. 1, 2009, which are all hereby incorporated by reference in their entirety.

TECHNICAL FIELD

The present invention relates to shower face, more particularly, to a plate-shaped shower face having micro-shower-holes formed therein to expand a passage area of liquid.

BACKGROUND ART

In general, a shower is a spraying device having a watering-pot shape to spray cold water or hot water and the shower has been broadly used as a body shower for family in a bath room, a sink and bath tub and a water pool, a water softener and a spa bath for business use.

Such a shower may be categorized into a sit-type shower and a stand-type shower and the shape of the shower may be variable according to the types.

After passing an inner path formed in a body of a shower head, cold water or hot water supplied via a hose may be sprayed outside toward a user via a plurality of shower holes formed in a shower face and the user may take a shower.

Recently, a water-saving shower capable of saving water has been used and the water-saving shower includes a diameter reducing part provided in a shower head to expand a diameter of an outer portion. Because of that, a water saving effect can be acquired. However, such a diameter reducing part requires a special part and the manufacture cost happens to be increasing disadvantageously.

In addition, according to a conventional water-saving shower, the number of shower holes is decreased or a diameter of a shower hole is reduced. In this case, proper water supply might not be performed or the shower time might be lengthened, when the user tries to take a shower. As a result, the water-saving effect happens to be useless disadvantageously.

Especially, if the diameter of the shower hole is decreased, generation of negative-ions may be increased together with the water-saving effect. However, the user cannot feel the shower effect properly and the water-saving effect tends to disappear.

As shown in FIGS. 1 and 2, Korean Paten Registration No. 0867486 filed by the present applicant discloses a shower face including a shower head 100, a thin plate shaped shower face 300 provided in a front portion of the shower head 100, shower holes 310 having small diameters, respectively, with an outer portion having a side of the shower face 300 insertedly coupled thereto.

In the shower face for the shower, water may be sprayed toward a broader area by liquid (W1) sprayed outside via a shower hole 310 after passing an inner path of the shower head 100 and liquid (W2) sprayed outside via a concave rectangular shaped spray hole 300 after passing the inner path of the shower head 100.

Although not shown in the drawings, if a direction of an inwardly recessed portion 331 of the shower hole 300 is located in a reverse direction, the direction of the liquid sprayed via an open part 333 may be changed and the liquid may be sprayed toward a narrow area.

However, such the shower face is formed in a plate shape and the shower hole 310 having a small diameter is provided in the plate-shaped shower face 300 such that a water-saving effect and a negative-ion generation effect and a liquid spraying angle control effect. However, there might be a disadvantage of a relatively small path area of the liquid sprayed outside because of the small diameter of the shower hole 310 and 330. As a result, a user might feel pricked.

DISCLOSURE OF INVENTION

Technical Problem

To overcome the above disadvantages, an object of the present invention is to provide a shower face a shower face having a plurality of shower hole arrays configured of a plurality of shower holes, which has a water-saving effect and which can enlarge a path area of liquid sprayed outside via the shower holes arrays to prevent a user from feeling pricked even when the spraying pressure is heightened.

Technical Solution

To achieve these objects and other advantages and in accordance with the purpose of the invention, in an embodiment, a shower face provided in front of a shower head, with a plurality of shower holes to discharge outside liquid having passed an inner path of the shower head, the shower face includes a plurality of shower hole arrays formed in the shower face, each of the shower hole arrays comprising a plurality of shower holes, wherein the shower hole array may include a center expanded hole comprising a plurality of direction changing parts expanded toward an inside of an open part, spaced apart a predetermined distance from each other along a circumferential direction of the open part, and a plurality of expanded spraying parts having outer boundary surface serially arranged from the open part to expand a path area of the liquid sprayed outside via the open part; and a plurality of peripheral collecting holes arranged outer to the center expanded hole along a circumferential surface, spaced apart a predetermined distance from each other, to change a path of the liquid toward the center expanded hole via the open part, as the direction changing parts expanded toward the inside of the open part are formed in opposite to the center expanded hole.

The plurality of the peripheral collecting holes may be arranged on an extended line of the expanded spraying part from a center of the center expanded hole.

The number of the peripheral collecting holes may be corresponding to the number of the expanded spraying parts formed in the center expanded hole.

In another embodiment of the present invention, a shower face provided in front of a shower head to discharge liquid outside after passing an inner path of the shower head, the shower face includes a plurality of shower holes, wherein a predetermined shower holes may include an expanded hole comprising a plurality of direction changing parts expanded toward an inside of an open part, spaced apart a predetermined from each other along a circumferential direction of the open part, and a plurality of expanded spraying parts having outer boundary surfaces serially arranged to expand a path area of the liquid sprayed outside via the open part.

According to this embodiment, the expanded hole may be clover-shaped.

Advantageous Effects

The present invention has following advantageous effects.

First of all, the plurality of the shower hole arrays formed to unit sprayed liquids may be arranged and there may be an effect of enabling the user to feel that sufficient liquid is supplied even if a small amount of liquid is supplied.

As a result, the substantial amount of the liquid used by the user may be reduced and there may be a water-saving effect.

Moreover, the shower hole arrays are formed to form the sprayed liquids in a single line. As a result, a diameter of each shower hole may be lessened and there may be an effect of increasing the amount of generated negative-ions.

Second, the shower hole may include the plurality of the expanded spraying parts formed to expand the path area of the liquid sprayed outside. There may be an effect of enabling the user to feel softness, even if the supply pressure of the liquid is high.

DESCRIPTION OF NUMERAL REFERENCES IN DRAWINGS

10: Shower Head, 20: Head Cap

30, 60: Shower Face, 32: Shower Hole Array

40: O-ring, 62: Expanded Hole

64: Shower Hole, 320: Center Expanded Hole

322, 342, 622: Direction Changing Part, 324: Expanded Spraying Part

326, 344: Open Part 340: Peripheral Collecting Hole

Best Mode

Reference will now be made in detail to the specific embodiments of the present invention, examples of which are illustrated in the accompanying drawings. Wherever possible, the same reference numbers will be used throughout the drawings to refer to the same or like parts.

Figure 1:
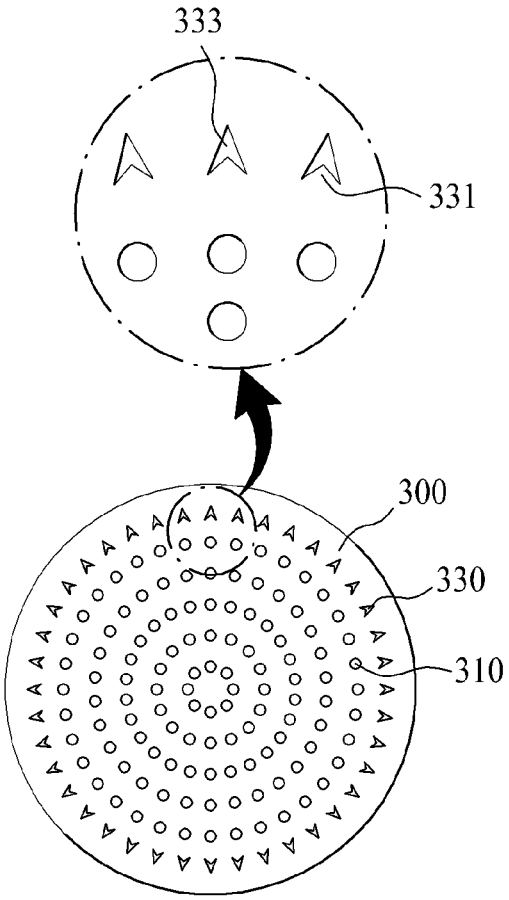
FIG. 1 is an enlarged view of a shower face according to a prior art.
Figure 2:
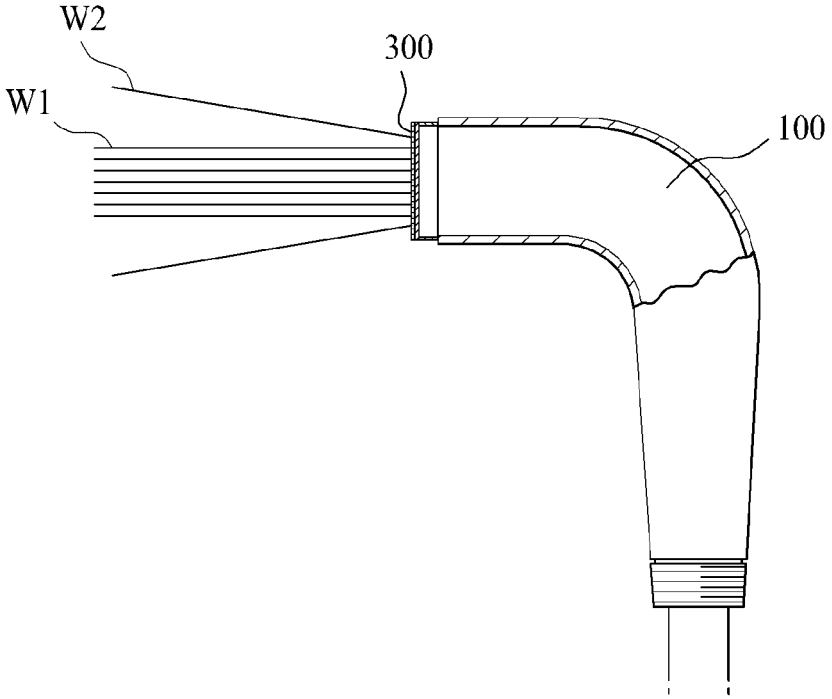
FIG. 2 is a diagram illustrating a usage state of a shower including the shower face shown in FIG. 1.
Figure 3:
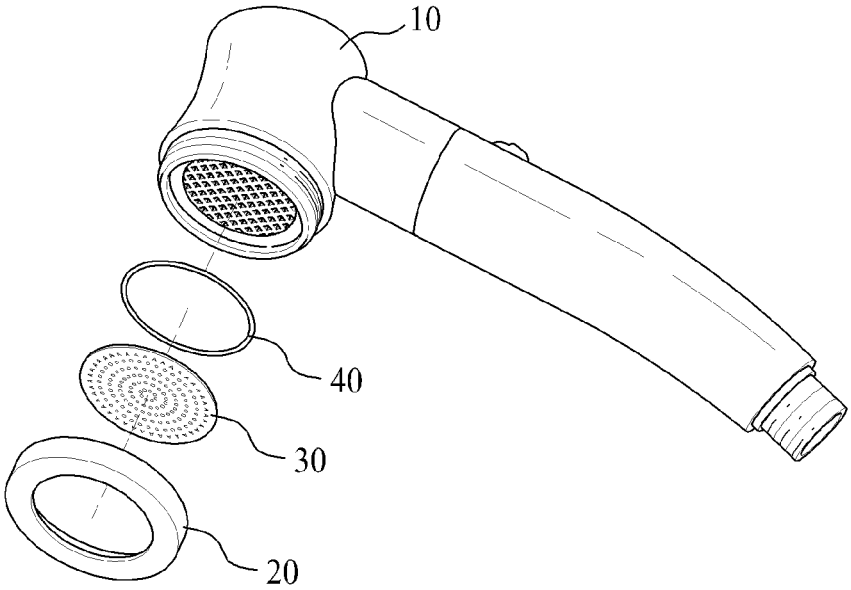
FIG. 3 is an exploded perspective view of a shower including a shower face according to the present invention.

First of all, in reference to FIG. 3, a configuration of a shower including a shower face according to the present invention will be described as follows. Here, FIG. 3 is an exploded perspective view of a shower including a shower face according to the present invention.

A shower including a shower face according to the present invention may include a shower head 10, a shower face 30, an O-ring 40 and a head cap 20.

Here, although not shown in the drawings, the shower head 10 may include an inner path liquid can flow along.

Also, a filter may be provided in the shower head 10 to remove foreign substances contained in the liquid flowing along the inner path.

The liquid having passed the inner path of the shower head 10 may be sprayed outside via the shower face 30 provided in front of the shower head 10, with a plurality of shower holes 320 and 340 formed therein.

The O-ring 40 may be provided to prevent the water from being leaked between the shower face 30 and the shower head 10 in the process of being sprayed outside via the shower face 30.

The head cap 20 may be coupled to the shower head 10 after the shower face 30 and the O-ring 40 are installed in the shower head 10. As a result, the head cap 20 may enhance an exterior appearance of the shower and it may protect the shower face 30 and the O-ring 40.

As shown in FIG. 3, it is embodied that the shower head 10 is a stand-type and the present invention is not limited thereto. The shower head 10 may be variable according to purposes.

Figure 4:
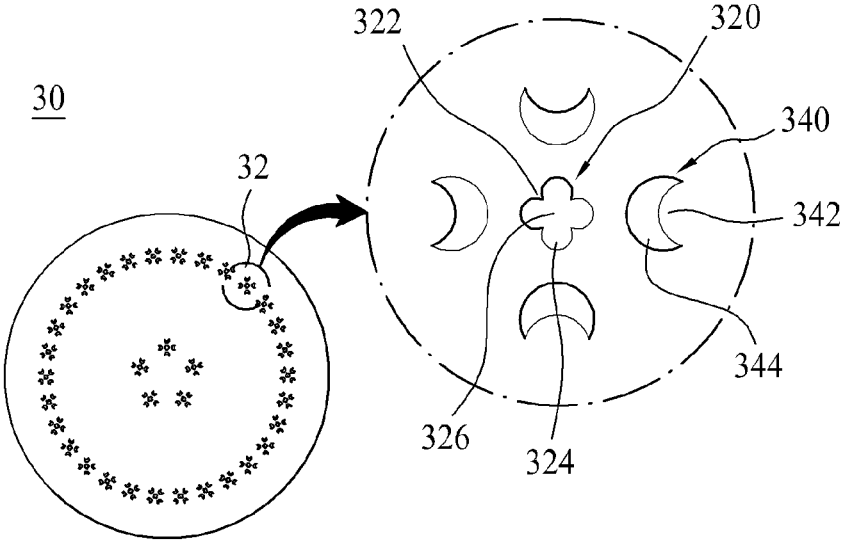
FIG. 4 is an enlarged view of a shower face according to an embodiment of the present invention.
Figure 5:
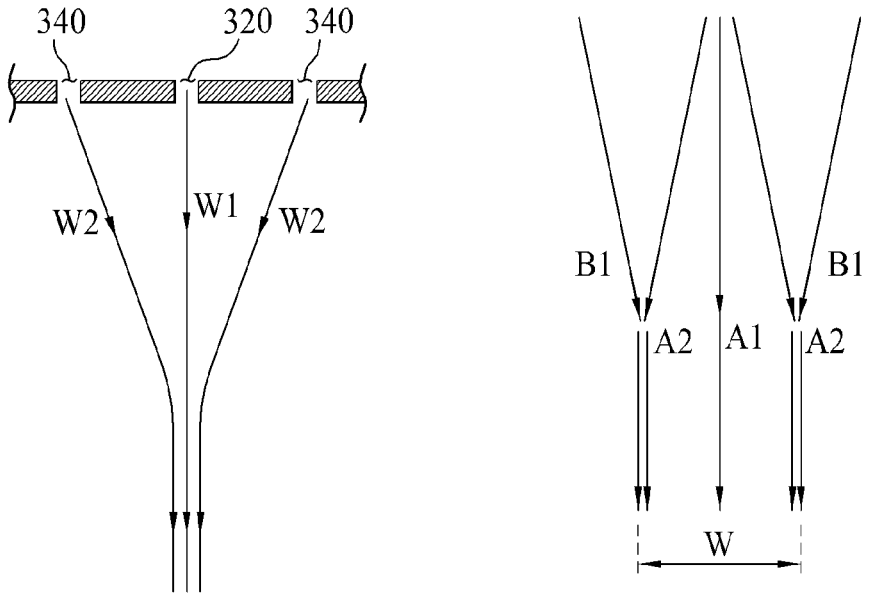
FIG. 5 is a diagram exaggeratedly illustrating a state of liquid sprayed via the shower face shown in FIG. 4.

Next, in reference to FIGS. 4 and 5, a shower face according to an embodiment of the present invention will be described as follows. Here, FIG. 4 is an enlarged view of a shower face according to an embodiment of the present invention. FIG. 5 is a diagram exaggeratedly illustrating a state of liquid sprayed via the shower face shown in FIG. 4.

The shower face 30 according to this embodiment may be provided in front of the shower head 10 and it may discharge the liquid having passed an inner path of the shower head 10 outside, as mentioned above.

Here a plurality of shower hole arrays 32 having a plurality of shower holes 320 and 340 may be formed in the shower face 30, as shown in FIG. 4.

A shower hole array 32 according to this embodiment may include an open part 326, a plurality of direction changing parts 322 inwardly expanded with respect to the open part 326, spaced apart a predetermined distance from each other along a circumferential direction of the open part 326, a center expanded hole 320 having a plurality of expanded-spraying-parts 324 formed by outer boundary surfaces of the open part 326 serially provided, to expand a path area of the liquid sprayed outside via the open part 326, and a plurality of peripheral collecting holes 340 arranged outer to the center expanded hole 320 along a circumferential direction, spaced apart a predetermined distance from each other, with a plurality of expanded-direction-changing parts 342 formed in opposite to the center expanded hole 320 to change a passage of the liquid toward the center expanded hole 320 via the open part 344.

Here, the plurality of the peripheral collecting holes 340 may be arranged along an extended line of the expanded spraying part 324 from a center of the center expanded hole 320.

As a result, the liquid sprayed outside via the peripheral collecting holes 340 may be integrated with the liquid sprayed via the center expanded hole 320. This process will be described later in detail in reference to FIG. 5.

Moreover, the number of the peripheral collecting holes 340 may be corresponding to the number of the expanded spraying parts 324 formed in the center expanded hole 320.

As four expanded spraying parts 324 of the center expanded hole 320 are provided according to this embodiment as shown in FIG. 4, four peripheral collecting holes 340 may be provided correspondingly.

However, this embodiment is not limited thereto and the number of the peripheral collecting holes 340 may be determined based on the number of the expanded spraying parts 324 of the center expanded hole 320.

As shown in FIG. 4, the peripheral collecting hole 340 according to this embodiment may be circular-shaped as a basic shower hole is circular-shaped and this embodiment is not limited thereto. The peripheral collecting hole 340 may have various shapes such as a concave rectangular shape formed from a heart or triangle shape of a basic shower hole.

As mentioned above, the center expanded hole 320 may include the plurality of the direction changing parts 322 arranged along a circumferential direction of the open part 326, spaced apart a predetermined distance from each other, such that the amount of the liquid sprayed via the expanded spraying parts 324 formed by the plurality of the direction changing parts 322 may be increased in the process of spraying the liquid having passed the inner path of the open part 326 and such that the path area of the liquid sprayed outside may be expanded.

Also, the direction changing part 342 of the peripheral collecting hole 340 may be expanded toward an inside of the open part 344 along an opposite direction of the center expanded hole 320.

As a result, the liquid sprayed outside via the peripheral collecting hole may be sprayed along a normal direction of the center expanded hole 320 by the direction changing part 342.

As follows will be described the process of spraying the liquid outside via the shower face 30 according to this embodiment after passing the inner path of the shower head 10, in reference to FIG. 5.

The path area of the liquid sprayed outside via the center expanded hole 320 may be expanded by the expanded spraying part 324 as shown in 'A1' of FIG. 5.

The liquid sprayed outside via the peripheral collecting hole 340 provided in the shower hole array 32 with respect to the center expanded hole 320 may be inclined along 'B1' direction toward the liquid sprayed via the center expanded hole 320, such that the liquids may be united.

As a result, the liquid sprayed via a single shower hole array 32 may have the broadly expanded path area (W) before sprayed outside, because the center expanded hole 320 is provided as shown in FIG. 5, and the liquids may be integrated (A1+A2), because the peripheral collecting holes 340 are provided.

As a result, the liquids may be united via a single shower hole array 32. Even if a small amount of liquid is supplied to the user, sufficient liquid may be provided. The path area (W) may be expanded by the center expanded hole 320 and the user will not feel pricked accordingly.

As mentioned above, the shower including the shower face 30 according to this embodiment may have a small sectional area of the shower hole array 32 and the amount of negative-ions discharged via the shower hole array 32 may be increased. There may be not only the water-saving effect but also an effect of enabling the user to feel soft even when the liquid is sprayed with a strong spraying pressure.

Figure 6:
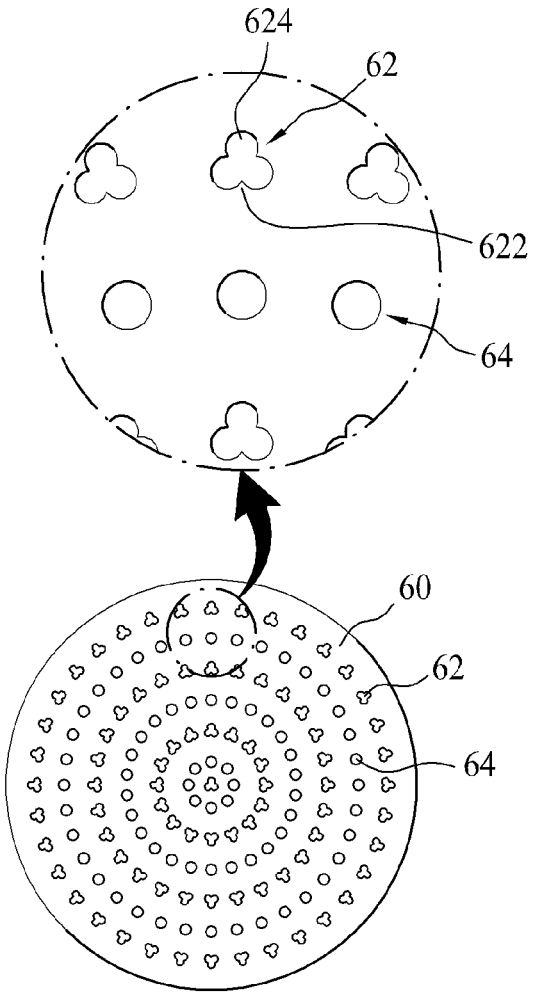
FIG. 6 is an enlarged view of a shower face according to another embodiment of the present invention.

Lastly, a shower face according to another embodiment of the present invention will be described in reference to FIG. 6. Here, FIG. 6 is an enlarged view of a shower face according to another embodiment of the present invention.

The shower face 60 according to this embodiment may be provided in front of the shower head 10 of FIG. 3 and it may discharge outside liquid passing an inner path of the shower head 10.

The shower face 60 according to this embodiment may include a plurality of shower holes 62 and 64. At least predetermined number of the shower holes 62 and 64 may include a plurality of direction changing parts 622 expanded toward an inside of an open part, spaced apart a predetermined distance from each other, and an expanded hole 62 having a plurality of expanded spraying parts 624 having outer boundary surfaces provided serially to expand a path area of the liquid passing the open part.

At least predetermined number of the shower holes 62 and 64 formed in the shower face 60 may be the expanded hole 62. Because of that, the liquid may have an expanded path area advantageously when it is sprayed outside after having passed the inner path of the shower head 10.

As shown in FIG. 6, this embodiment represents that the expanded hole 62 according to this embodiment may include three expanded spraying parts 624 are clover-shaped and the embodiment is not limited thereto. The number of the expanded spraying parts 624 may be variable according to molds.

The shower face 60 according to this embodiment may include circular-shaped shower holes 64 and the clover-shaped expanded holes 62 which are alternatively arranged in a line, as shown in FIG. 6. However, the plurality of the shower holes 62 and 64 formed in the shower face 60 may be the expanded holes 62.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A shower water spray plate provided in front of a shower head, with a plurality of shower holes to discharge outside liquid having passed an inner path of the shower head, the shower water spray plate comprising:

a plurality of shower hole arrays formed in the shower water spray plate, each of the shower hole arrays including a center expanded hole having a clover shape and a plurality of peripheral collecting holes disposed along a circumference of the center expanded hole, the plurality of shower hole arrays being disposed on the water spray plate along a concentric circle arranged on a circumference of the water spray plate, the center expanded hole including a plurality of expanded spraying parts which are configured to expand a cross sectional area of the liquid pathway; and the plurality of peripheral collecting holes having a crescent shape, a concave rectangular shape, a heart shape or triangle shape being concavely formed relative to the center expanded hole.

2. The shower water spray plate according to claim 1, wherein each of the plurality of the peripheral collecting holes is disposed along a line that extends from a center of the center expanded hole toward a corresponding one of the expanded spraying parts.

3. The shower water spray plate according to claim 1, wherein a number of the peripheral collecting holes is same as a number of the expanded spraying parts formed in the center expanded hole.

* * * * *